United States Patent [19]

Vandevier

[11] 4,426,124

[45] Jan. 17, 1984

[54] FEED THROUGH MANDREL FOR SUBMERSIBLE PUMP

[75] Inventor: Joseph E. Vandevier, Claremore, Okla.

[73] Assignee: Hughes Tool Company, Houston, Tex.

[21] Appl. No.: 308,057

[22] Filed: Oct. 2, 1981

[51] Int. Cl.[3] ..... H01R 9/11

[52] U.S. Cl. ..... 339/94 M; 339/205

[58] Field of Search ..... 339/94 R, 94 A, 94 C, 339/94 L, 94 M, 205

[56] References Cited

U.S. PATENT DOCUMENTS

| | | | |
|---|---|---|---|
| 2,177,508 | 10/1939 | Abbott | 339/94 R |
| 2,674,645 | 4/1954 | Fine | 339/94 A |
| 2,731,610 | 1/1956 | Thacker | 339/94 R |
| 2,750,436 | 6/1956 | Richter | 174/77 |
| 2,795,397 | 6/1957 | Hull et al. | 255/28 |
| 2,866,957 | 12/1958 | Raypholtz | 339/205 |
| 3,059,210 | 10/1962 | Luenberger | 339/94 R |
| 3,290,639 | 12/1966 | Driemeyer | 339/94 R |
| 3,437,149 | 4/1969 | Cugini et al. | 166/315 |
| 3,522,576 | 8/1970 | Cairns | 339/205 |
| 3,736,548 | 5/1973 | Double | 339/31 |
| 3,750,088 | 7/1973 | Berian | 339/94 |
| 3,850,495 | 11/1974 | Glover | 339/94 M |
| 3,900,701 | 8/1975 | Bayles et al. | 174/102 |
| 3,989,330 | 11/1976 | Cullen | 339/16 |
| 3,998,515 | 12/1976 | Panek | 339/117 |
| 4,039,237 | 8/1977 | Cullen | 339/91 |
| 4,079,191 | 3/1978 | Robertson et al. | 174/121 |
| 4,174,145 | 11/1979 | Oeschger | 339/94 |

FOREIGN PATENT DOCUMENTS

| | | | |
|---|---|---|---|
| 770307 | 3/1957 | United Kingdom | 339/94 R |

OTHER PUBLICATIONS

Seaboard Wellhead Control, Inc.—Catalog 76—p. 17.

*Primary Examiner*—John McQuade
*Assistant Examiner*—Gary F. Paumen
*Attorney, Agent, or Firm*—Robert A. Felsman; James E. Bradley

[57] ABSTRACT

An electrical coupling particularly for submersible pumps serves as a barrier between high and low pressure zones and allows electrical cables to be connected through it. The coupling includes a jacket mounted in a housing. The jacket has at least one tapered hole extending through it. A conductor rod is bonded to a dielectric sheath and inserted into the hole. The sheath is compressed in the hole to provide sealing. The sheath is preferably of glass bonded mica.

4 Claims, 3 Drawing Figures

FEED THROUGH MANDREL FOR SUBMERSIBLE PUMP

BACKGROUND OF THE INVENTION

This invention relates in general to submersible pumps, and in particular to an electrical coupling that provides a boundary between high and low pressure zones and also provides an electrical connection between electrical cables in the low and high pressure zones.

In a typical large volume submersible pump installation, an electrical motor will be located downhole for rotating a centrifugal pump. Electrical conductors extend from the surface to the motor. If the wellhead is under pressure, the conductors must feed through a barrier separating high wellhead pressure from low surface pressure. Also, in certain installations using downhole packers, the conductor must extend from a high pressure zone into a low pressure zone.

Feed-through mandrels are available for providing a barrier between different pressure zones and for connecting electrical cable from the two separate zones. These mandrels usually have a thermoset insulation material molded around copper conductors. In general, these types will withstand up to about 3,000 psi (pounds per square inch) pressure differential. One disadvantage is that if gas is present in the wellhead, the gas may enter the thermoset material under pressure. When pressure is relieved, the gas will expand, possibly destroying the insulation material.

It is known that glass based materials, such as glass bonded mica, can be compressed against a rigid surface such as metal to very high pressures to form a seal. Also, these glass bonded mica materials are dielectric, thus provide good insulators. Feed-through mandrels for submersible pump installations, to applicant's knowledge, however, do not utilize glass based materials.

SUMMARY OF THE INVENTION

In this invention, a feed-through mandrel is provided that utilizes a rigid jacket located within a housing. The jacket has a hole for each conductor. The holes are conical and receive conductor rods which protrude past the ends of the jacket for connecting to electrical cable. The conductor rods are bonded within conical sheaths that fit tightly in the holes in the jacket. The sheaths are of a glass based material and are pressed tightly by compression means against the jacket to form a tight seal as well as a good insulator.

DESCRIPTION OF THE PREFERRED EMBODIMENT

Figure 1:
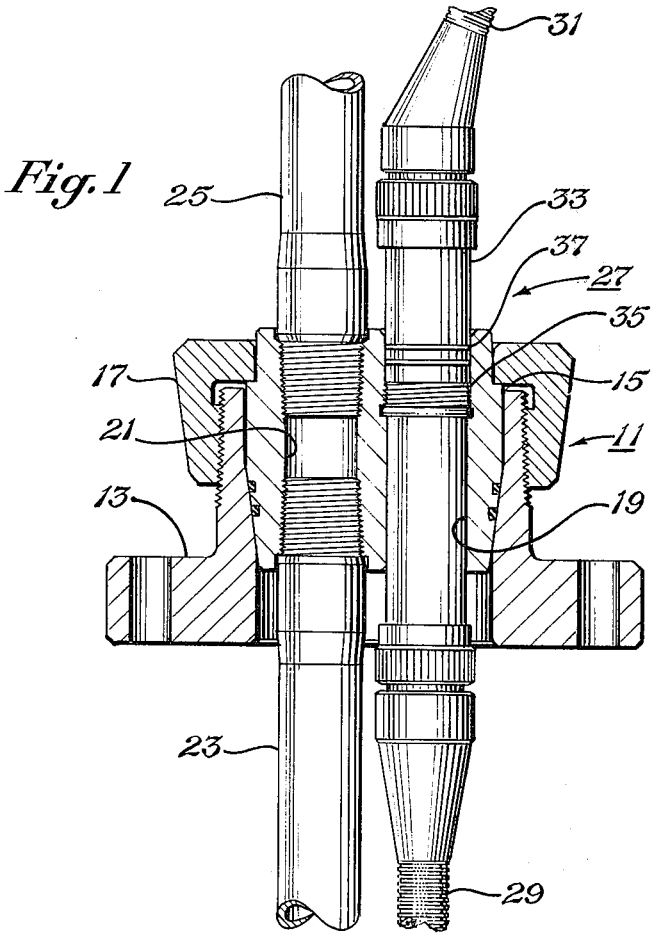
FIG. 1 is a partially sectioned view of part of an adapter showing a feed-through mandrel constructed in accordance with this invention.

Referring to FIG. 1, an adapter 11 includes a threaded member 13 for bolting to a portion of the wellhead. Member 13 is tubular and has a tubing hanger 15 adapted to be sealed within its bore. Tubing hanger

15 is held in place by means of a cap or threaded ring 17. Tubing hanger 15 has two passages 19 and 21. Passage 21 has threads for retaining tubing 23, through which fluid from one of the zones in the well will be produced. A pipe 25 is secured in the exit end of passage 21 and leads to separation and storage equipment. A feed-through mandrel 27 is located in passage 19. Feed-through mandrel 27 seals any pressure within the wellhead and interior of connection member 13. Feed-through mandrel 27 also enables the connection of a connector 29 for a cable leading to the pump motor (not shown) with a connector 31, which connects a cable leading to the power supply and control equipment on the surface (not shown).

Figure 2:
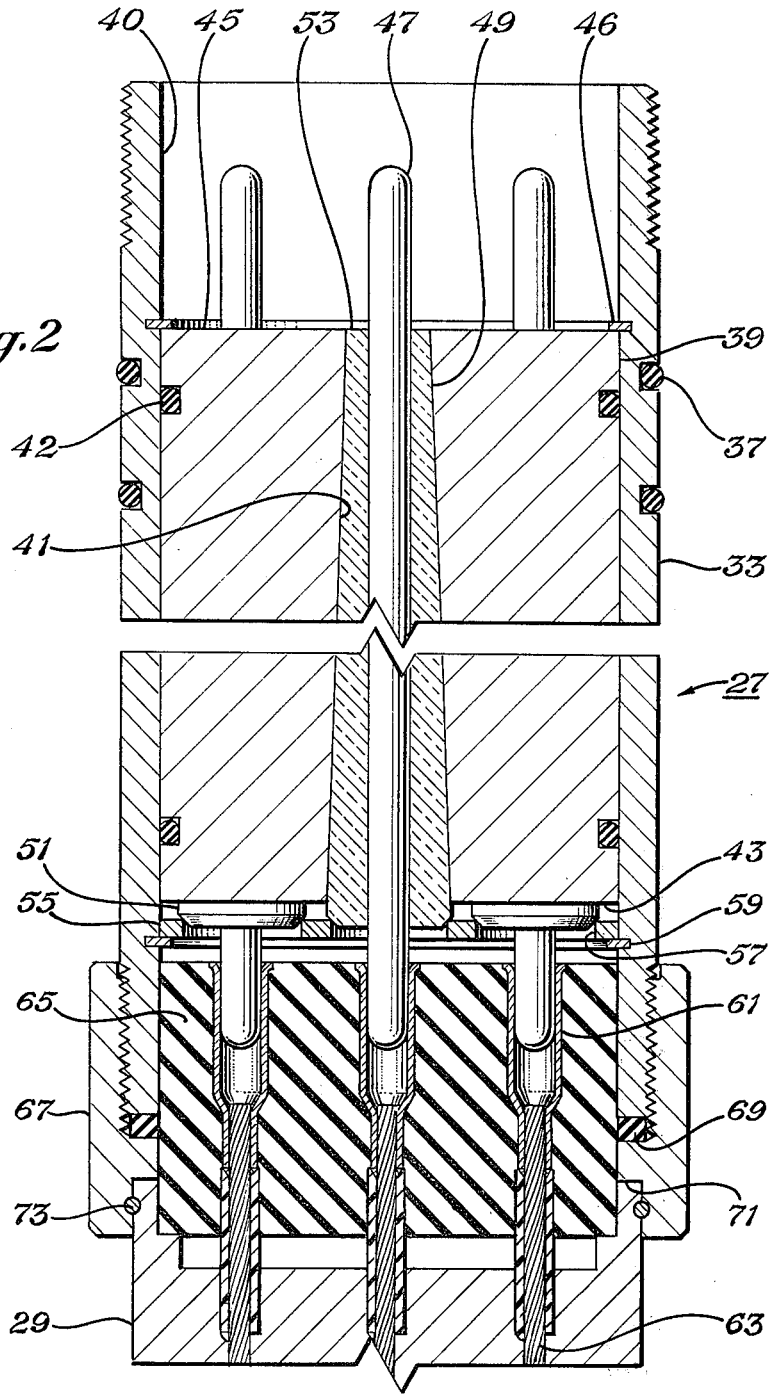
FIG. 2 is an enlarged cross-sectional view of the feed-through mandrel of FIG. 1.

Feed through mandrel 27 includes a tubular housing 33 that is secured within passage 19 by threads 35. O-rings 37 seal the housing 33 within passage 19. The upper and lower ends of housing 33 are threaded for receiving the connectors 29 and 31. Referring to FIG. 2, housing 33 has a cylindrical bore 40 that closely receives a rigid, preferably metal, jacket 39. O-rings 42 seal jacket 39 within bore 40. Jacket 39 is a solid plug but for a frusto-conical hole 41 extending through it for each of the conductors of the electrical cable. Normally there will be three holes 41. Each hole 41 has a larger diameter on the high pressure side or end 43 and tapers gradually to a smaller diameter on the lower pressure end 45. The three holes 41 are equally spaced 120 degrees apart about the axis of jacket 39. Referring again to FIG. 2, the low pressure end 45 of jacket 39 is retained by a stop means comprising a snap ring 46 retained within a groove formed in the bore 40 of housing 33. Snap ring 46 prevents further movement of jacket 39 in the low pressure direction.

Three conductor rods 47, each of a conducting material such as copper, are bonded concentrically within a sheath or insulator 49. Rod 47 protrudes beyond the ends of sheath 49 and beyond the ends 43 and 45 of jacket 39. Sheath 49 has an exterior that is frusto-conical and of the same taper and cross-sectional dimensions as the holes 41. Sheath 49 has a high pressure end 51 that has an annular face perpendicular to rod 47. High pressure end 51 protrudes beyond the high pressure end 43 of jacket 39 a short distance. Sheath 49 has low pressure end 53 that has an annular face that is perpendicular to the axis of rod 47 and flush with the low pressure end 45 of jacket 39. Sheath 49 is a dielectric material for forming good insulation, and is also a glass based material such as ceramic, aluminum oxide or glass bonded mica. Extreme pressures can be mechanically exerted between the sheath 49 and jacket 39, to provide a high pressure isolator while retaining electrical insulation.

Figure 3:
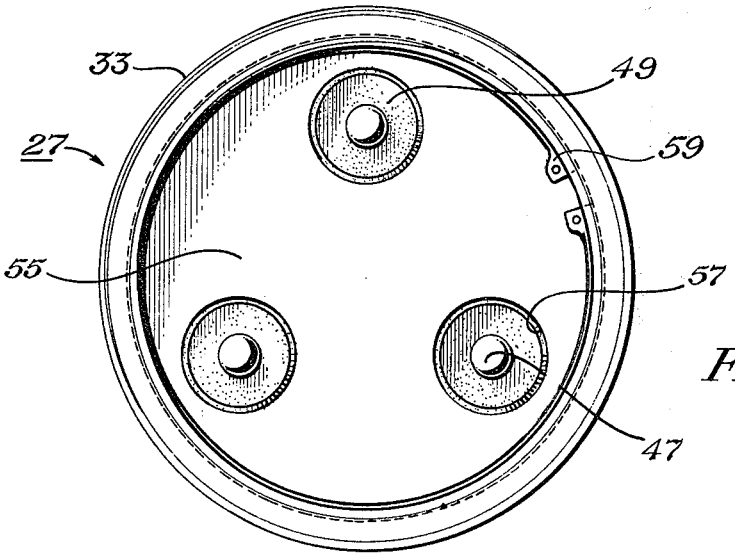
FIG. 3 is an end view of the lower end of the feed-through mandrel of FIG. 2, with the lower connector removed.

A circular plate 55 is used to serve as compression means for compressing the sheaths 49 into the holes 41 and retaining them under compression. Plate 55, as shown also in FIG. 3, has three apertures 57 spaced 120 degrees apart. Apertures 57 are adapted to be received over the ends of the three conductor rods 47. Apertures 57 are smaller in diameter than the high pressure ends 51 of the sheaths 49. This causes the plate 55 to bear against the high pressure ends 51. During assembly, a hydraulic press (not shown) will be used to press plate 55 against the sheaths 49, with the retaining ring 46 serving as a backup. While under tight compression, a retaining or snap ring 59 is inserted into a groove formed in the bore 40 of housing 33 to retain the plate 55 in compression. The high compression causes the sheaths 49 to form a tight seal against jacket 39. Plate 55 and retaining ring 59 thus serve as compression means for compressing sheaths 49 in jacket 39.

The connectors 29 and 31 are conventional, with only a portion of the connector 29 being shown in detail, and connector 31 not being shown in detail. Referring to FIG. 2, connector 29 has three sockets 61 spaced 120 degrees apart for close reception over the protruding ends of the conductor rods 47 to make electrical connection. Each socket 61 is connected to one of the conductors 63 leading to the pump motor. A thermoset insulation material 65 is molded around the sockets 61. A threaded sleeve 67 engages threads on the high pressure end of housing 33 to secure the sockets 61 over the conductor rods 47. The insulation material 65 has an annular band 69 that provides sealing when compressed between the end of housing 33 and an interior band 71 located in threaded sleeve 67. A steel wire 73 holds the sleeve 67 in place.

To install the system, the submersible pump (not shown) will be lowered into the well and anchored by a suitable means. The three conductors 63 leading to the motor of the pump will be conducted to connecting member 29. Housing 33 will be secured in tubing hanger 15 before the tubing hanger is sealed in adapter member 13. Connecting member 31, which leads to the power supply and control equipment for the submersible pump motor, will be connected to the upper end of housing 33. Connecting member 29 will be connected to the lower end of housing 33, with its sockets 61 engaging the conductor rods 47 as shown in FIG. 2. Conduit 23 is secured to tubing hanger 15. Then tubing hanger 15 will be lowered into adapter member 13 and secured tightly by cap 17. Tubing 23 is supported by tubing hanger 15. Conduit 25 leads to separation and storage equipment for the fluid being produced from the well.

In operation, electrical energy is provided through connector 31, conductor rods 47, connector 29 and conductors 63 to the pump motor. Any pressure below tubing hanger 15 will be sealed by the sheaths 49, jacket 39, and housing 33. Sheaths 49 also insulate the conductor rods 47.

The invention has significant advantages. The feed-through mandrel provide a pressure barrier that will seal against very high pressure differential, yet allow electrical continuity through the barrier. The glass bonded mica insulators provide good insulation and withstand high pressures. The insulators are not subject to deterioration by high pressure gas from the well.

While the invention has been shown in only one of its forms, it should be apparent to those skilled in the art that it not so limited but is susceptible to various changes and modifications without departing from the spirit of the invention.

I claim:

1. An electrical coupling for making an electrical connection through a structure between low and high pressure zones, comprising in combination:

a rigid jacket sealingly carried in a passage in the structure, separating the low and high pressure zones, the jacket having at least one frusto-conical hole extending through it;

a conductor rod located within a dielectric sheath that has a frusto-conical exterior for close reception in the hole, the conductor rod having opposite ends protruding from the sheath for connection to electrical conductors in the high and low pressure zones; and compression means for compressing the sheath in the hole at a sufficient pressure to form a seal between the sheath and jacket to prevent pressure leakage through the hole;

the sheath being of a material selected from the group consisting of glass bonded mica, ceramic, and aluminum oxide.

2. An electrical cable feed-through mandrel, comprising in combination:

a tubular housing;

a rigid jacket carried sealingly inside the housing and having at least one hole extending through the jacket;

a conductor rod having a sheath with an exterior for close reception in the hole and having opposite ends protruding from the sheath for connection to electrical conductors; and compression means for compressing the sheath in the hole at a sufficient pressure to form a seal between the sheath and the jacket;

the sheath being of a material selected from the group consisting of glass bonded mica, ceramic, and aluminum oxide.

3. An electrical cable feed-through mandrel, comprising in combination:

a housing;

a rigid jacket having a cylindrical exterior sealingly received within the housing, the jacket having a plurality of frusto-conical holes extending through the jacket;

a plurality of conductor rods, each having a sheath with a larger end, a smaller end, and a frusto-conical exterior for close fitting reception in one of the holes, with the rods having ends that protrude from the jacket for connection on opposite ends of the jacket to electrical conductors in different pressure zones;

a rigid plate having a plurality of apertures, each aperture for insertion over one of the ends of the rods and being of lesser diameter than the diameter of the large end of each sheath, the plate bearing against the large end of each sheath to cause the sheaths to seal against the jacket; and retaining means for retaining the plate in sufficient compression against the sheaths to cause the sheaths to seal against the jacket to prevent pressure leakage through the holes of the jacket;

the sheaths being of a material selected from the group consisting of glass bonded mica, ceramic, and aluminum oxide.

4. In a submersible pump installation within a well of the type having a plurality of electrical conductors extending upwardly within a high pressure zone in well conduit, an improved means for connecting the conductors through a pressure barrier structure to a low pressure zone, comprising in combination:

a tubular housing mounted to a passage in the structure;

a rigid metal jacket having a cylindrical exterior sealingly received in the housing, the jacket having a conical hole extending through it for each of the conductors, with a smaller end on a low pressure end of the jacket and a larger end on a high pressure end of the jacket;

stop means on the low pressure end of the jacket for preventing movement of the jacket toward the low pressure zone;

a conductor rod for each conductor, each conductor rod having a sheath bonded to it with a conical exterior that mates with one of the holes, the rods having ends that protrude from the jacket for connection to one of the cables in the low and high pressure zones;

a plate having an aperture for inserting around each rod, each aperture being of lesser diameter than the larger diameters of the holes, the plate bearing against ends of the sheaths on the high pressure end of the jacket to cause the sheaths to seal against the jacket; and retaining means for retaining the plate in sufficient compression against the sheaths to form a seal between the sheaths and jacket to prevent pressure leakage through the holes of the jacket;

the sheaths being of a material selected from the group consisting of glass bonded mica, ceramic, and aluminum oxide.

* * * * *